US006484807B2

(12) United States Patent
Allen

(10) Patent No.: US 6,484,807 B2
(45) Date of Patent: Nov. 26, 2002

(54) WELLHEAD ASSEMBLY FOR INJECTING A FLUID INTO A WELL AND METHOD OF USING THE SAME

(75) Inventor: Timothy J. Allen, Houston, TX (US)

(73) Assignee: Cooper Cameron Corporation, Houston, TX (US)

( * ) Notice: Subject to any disclaimer, the term of this patent is extended or adjusted under 35 U.S.C. 154(b) by 0 days.

(21) Appl. No.: 09/726,006

(22) Filed: Nov. 29, 2000

(65) Prior Publication Data

US 2002/0062966 A1 May 30, 2002

(51) Int. Cl.[7] ..... E21B 43/40; E21B 33/04
(52) U.S. Cl. ..... 166/368; 166/89.1
(58) Field of Search ..... 166/89.1, 344, 166/368

(56) References Cited

U.S. PATENT DOCUMENTS

| | | | | |
|---|---|---|---|---|
| 3,705,623 A | * | 12/1972 | van Eek et al. | 166/338 |
| 3,827,486 A | * | 8/1974 | Hall | 166/359 |
| 4,887,672 A | * | 12/1989 | Hynes | 166/344 |
| 4,942,929 A | | 7/1990 | Malachosky et al. | 175/66 |
| 5,085,277 A | * | 2/1992 | Hopper | 166/335 |
| 5,129,469 A | | 7/1992 | Jackson | 175/66 |
| 5,213,162 A | * | 5/1993 | Iato | 166/341 |
| 5,226,478 A | | 7/1993 | Henderson, Jr. et al. | 166/285 |
| 5,255,745 A | | 10/1993 | Czyrek | 166/347 |
| 5,339,912 A | | 8/1994 | Hosie et al. | 175/66 |
| 5,341,882 A | | 8/1994 | Hale | 166/293 |
| 5,372,199 A | | 12/1994 | Cegielski et al. | 166/368 |
| 5,544,707 A | | 8/1996 | Hopper et al. | 166/382 |
| 5,613,242 A | | 3/1997 | Oddo | 588/17 |
| 5,662,169 A | | 9/1997 | Hosie | 166/344 |
| 5,884,715 A | * | 3/1999 | Reddoch | 175/207 |
| 5,971,077 A | * | 10/1999 | Lilley | 166/348 |
| 6,039,119 A | | 3/2000 | Hopper et al. | 166/368 |

FOREIGN PATENT DOCUMENTS

WO WO 9704211 A1 * 2/1997 ..... E21B/33/035

OTHER PUBLICATIONS

DRIL–QUIP, General Catalog, "*Special Applications, Cuttings Injection System*", 1994, p. 34.

(List continued on next page.)

*Primary Examiner*—David Bagnell
*Assistant Examiner*—Daniel P Stephenson
(74) *Attorney, Agent, or Firm*—Michael P. Hartmann; Peter A. Bielinski; Jackie L. Duke

(57) ABSTRACT

A wellhead assembly comprises an outer housing having a central bore therethrough and an inner housing having a central bore therethrough secured in the central bore of the outer housing. The inner housing has a first end within the outer housing. A first inner casing having a central bore therethrough is secured at a first end in the outer housing and spaced from the first end of the inner housing. A port is provided through the outer housing in communication with the central bore therethrough, the port opening into the central bore of the outer housing between the first end of the inner housing and the first end of the first inner casing. A second inner casing is secured in the wellhead assembly at a first end, whereby the port opens into the central bore of the outer housing between the first end of the first inner housing and the first end of the second inner housing. An annulus is formed between the first and second inner casings. A flowpath for fluid injection into a well in which the wellhead assembly is installed comprises the port in the outer housing and the annulus between the first and second inner casings. A method for injecting fluid into the wellhead assembly and the well along the aforementioned flowpath is also provided. The wellhead assembly and method are particularly suitable for the injection of a slurry of drilling cuttings into the well and underground formations into which the well extends.

21 Claims, 3 Drawing Sheets

OTHER PUBLICATIONS

Brochure, Kvaerner Oil & Gas, "Subsea Wellhead System", 1999, 8 pages.

Ferguson et al. "Subsea Cuttings Injection Guide Base Trial" Offshore European Conference; SPE 26681, Sep. 7–10, 1993.

Saasen et al. "The First Cuttings Injection Operation Worldwide in a Subsea Annulus: Equipment and Operational Experience" SPE Annual Technical Conference adn Exhibition; SPE 48985 Sep. 27–30, 1998.

* cited by examiner

WELLHEAD ASSEMBLY FOR INJECTING A FLUID INTO A WELL AND METHOD OF USING THE SAME

TECHNICAL FIELD OF THE INVENTION

The present invention relates to a wellhead assembly for injecting a fluid, in particular a slurry of cuttings from a well drilling operation, into a well and a method for its use. The well is especially a subsea well. The method and apparatus of the present invention may be applied in, but are not limited to, the disposal of drilling muds and drilling cuttings prepared in the form of a liquid slurry.

BACKGROUND OF THE INVENTION

The drilling of an oil or gas well, for example a subsea well, results in the formation of small fragments of rock and other matter, known as cuttings, from the various formations through which the well is drilled. The cuttings are removed from the well as they are formed by the drill bit by being entrained in a drilling mud pumped down the well and returned to the surface vessel or platform. The cuttings are typically recovered from the drilling mud by a separation process and the mud reused in the well operations. In the past, at offshore locations, it has been common practice to dispose of the cuttings separated from the drilling mud in this way by dumping them in the sea. This practice has proven acceptable in the past, as the drilling muds employed were water based in composition and, as such, cuttings separated from such water based slurries gave rise to minimal, if any, environmental impact when disposed of in the aforementioned manner. Additionally, many companies have changed their practice to use synthetic drilling mud that is environmentally friendly.

Recently, however, it has become favoured to employ oil based drilling muds, as such mud formulations offer a number of advantages. For example, oil based muds improve the stability of the well bore, improve the performance of the drill bit by providing better lubrication and removal of cuttings as they are formed, and reduce the torque generated in the drill string during use. For these reasons, oil based drilling muds have been finding increasing use. While offering advantages during the drilling operation, the oil based mud formulations present a problem with respect to disposal. Cutting separated from the oil based muds after recovery from the well are inevitably contaminated with the oil based formulation. Washing the cuttings has been attempted, but only removes the mud from the surface of the cuttings particles, leaving oil in the cracks and pores of the fragments. It is no longer possible to dispose of cuttings recovered from an offshore well using oil based drilling muds in the same manner as when water based muds are employed by simply pouring the cuttings into the sea, due to a damaging environmental impact. The corresponding environmental regulations now prohibit this method of disposal.

Accordingly, it has been the practice to dispose of the cuttings by injecting them into a well and into subsurface formations. To facilitate this, it has been the practice to grind the cuttings and suspend them in a suitable liquid to form a pumpable slurry, which may then be injected into a subsurface formation through an annulus between adjacent casings in the well. This has been common practice in environmentally sensitive areas, such as the north slope of Alaska, for many years.

U.S. Pat. No. 4,942,929 discloses a method for the disposal and reclamation of drilling wastes, in which construction grade gravel is separated from drilling cuttings produced during well drilling operations. The solids that are not so recovered are formed as a slurry with the remaining clays, silts and spent drilling fluid and conducted to a second well, remote from the well being drilled, into which the slurry is injected. Centrifugal pumps or mechanical agitators are used to disperse the fine solids in the slurry to assist in the injection process.

A drill cutting disposal method and system is disclosed in U.S. Pat. No. 5,129,469. In the method and system disclosed, drill cuttings produced during well drilling operations are brought to the surface and separated from the drilling mud, mixed with a suitable liquid, such as sea water and the mixture subjected to grinding to form a slurry. The slurry may then be pumped into a selected zone of the well for disposal.

U.S. Pat. No. 5,341,882 discloses a method for the disposal of well drilling cuttings, in which the cuttings are solidified by combining the cuttings with water and blast furnace slag. The resulting mixture is injected into the annulus between two wellbore casings, where it solidifies to form a cement.

U.S. Pat. No. 5,255,745 describes a method and apparatus for providing a remotely operable connection to establish access to an annulus within a wellhead assembly. The apparatus requires a port in the wellhead assembly. A valve is positioned to seal with the port by remote means using a ramp assembly supported on a guide base positioned around the wellhead.

U.S. Pat. No. 5,884,715 discloses a method and apparatus for injecting cuttings into a well while drilling operations are in progress. Two embodiments are discussed in the disclosure. The first method requires a predrilled well bore to be bored adjacent to and extending away from the well being drilled. The predrilled well bore is used as a depository for the drilling cuttings produced from the well being drilled. The second embodiment requires an injection tube to be installed within the well being drilled alongside the casings set into the well, through which access can be gained to subsurface formations into which the cuttings may be injected. A further embodiment employs an annulus between adjacent casings in the well in order to gain access to underground formations. It is noted that the embodiments disclosed in U.S. Pat. No. 5,884,715 relate to the injection of cuttings into a well having a wellhead accessible on land. While subsea operations are mentioned, little information is given regarding the injection of cuttings into subsea wells.

A subsea wellhead typically comprises a conductor pipe extending below the sea bed in the well, the upper portion of which extends from the well and forms a conductor housing. A high pressure housing is landed in the conductor housing, on which is typically mounted a blowout preventer (BOP) stack by means of a BOP guide funnel. Successively smaller casings are landed in the wellhead, suspended from casing hangers secured within the conductor pipe or the high pressure housing. A guide base is often employed, which comprises a structure extending around the wellhead and mounted to the conductor housing.

A subsea well injection system is disclosed in U.S. Pat. No. 5,085,277, for injecting unwanted slurries and other fluids arising from drilling or other downhole operations into a subsea well. The slurry or other fluid is injected through a drilling guide base positioned around the well on an underwater surface. The system employs a dedicated guide base, which comprises pipework on the guide base leading to a port in the conductor housing of the well, thus gaining access to the annulus between the conductor casing and the adjacent inner casing. A fail safe isolation valve is provided on the guide base and joined to the pipework. A coupling is provided to connect the isolation valve to a surface vessel or platform. The wellhead is modified to provide a port in the conductor housing, in order to gain access to an annulus between casings within the well. With a single port in the outermost housing of the well, fluids may be injected into the outermost annulus of the well. If access is required to an inner annulus, similar ports are required in the casings disposed radially outwards of the inner annulus to provide a flow path to the pipework extending from the guide base.

In U.S. Pat. No. 5,339,912, there is disclosed a cuttings disposal system in which an injection adapter is employed to allow a slurry of cuttings to be injected into a well. The well, designated an "injection well", has an inner and an outer wellhead housing with at least one casing hanger and a respective inner casing installed in the inner wellhead housing. The casing hanger is formed with a port through it, connecting the bore of the well with the annulus between the inner casing and the outer casing of the well. When it is desired to inject cuttings into the well, an injection adapter is landed in the wellhead so as to extend into the bore of the well, allowing a central bore in the injection adapter to connect, through a port in the side of the injection adapter body, with the port in the casing hanger. The central bore in the injection adapter is connected by pipework to a pump at the surface, by means of which a slurry of cuttings may be injected through the injection adapter and into the annulus in the well. It is noted that, with the injection adapter landed in the well, access to the well for conducting other operations is denied, until the cuttings injection operation is ceased and the injection adapter removed.

In a paper entitled "Subsea Cuttings Injection Guide Base Trial" presented at the Offshore European Conference, Sep. 7 to 10, 1993, Ferguson et al. disclosed the results of field trials conducted to test a permanent guide base and wellhead assembly modified to allow cuttings injection. A modified permanent guide base was employed having a pipe connecting through the guide base to a port in an extension welded to the conductor housing of the wellhead. A similar extension was provided on the lower end of the high pressure housing, through which a port was formed to align with the port in the extension to the conductor housing and provide access to an inner annulus of the wellhead assembly. As with the system of U.S. Pat. No. 5,662,169, a dedicated guide base is required in this system in order to provide the possibility of cuttings injection, together with modifications to several of the wellhead components.

A similar cuttings injection system is disclosed by Saasen et al. in a paper entitled "The First Cuttings Injection Operation Worldwide in a Subsea Annulus: Equipment and Operational Experience", presented at the SPE Annual Technical Conference and Exhibition, Sep. 27 to 30, 1998. Saasen et al. indicate that prior to 1998 cuttings re-injection had been restricted to fixed platforms. Saasen et al. state that annular re-injection into subsea wells, where drilling operations are in progress had not been feasible. Accordingly, Saasen et al. report on a new development to provide a system to achieve cuttings re-injection, while drilling operations are taking place. The system employs a modified guide base, required to be larger than conventional guide bases, through which access is gained to a port formed in the conductor housing. A similar port is provided in the high pressure housing, aligned with the port in the conductor housing, in order to access an annulus between the high pressure housing, and its associated casing, and a casing suspended from a casing hanger secured in the bore of the high pressure housing. Again, the system of Saasen et al. requires a modified, dedicated guide base to be provided in order to inject cuttings into an annulus within the wellhead assembly. Further, in the system of Saasen et al. seal cartridges are required to be provided within the conductor housing around the high pressure housing both above and below the ports in the conductor housing and high pressure housing, in order to avoid ingress of the cuttings slurry into the annulus between the conductor housing and the high pressure housing.

As can be seen from the above review of the prior art, wellhead assemblies have been proposed which employ a guide base having one or more ports which align axially, and in some cases circumferentially, with corresponding ports in the conductor housing, in order to gain access to an annulus within the well. Saasen et al. indicate that the only practical application of cuttings re-injection into a well while drilling operations are taking place requires a dedicated guide base, having ports which connect with ports in the wellhead housing. It would be advantageous if way could be found to dispense with the need to provide ports in the guide base, thus reducing the overall number of seals required, with a corresponding reduction in the possibility of a failure of the system resulting in a leak.

A cuttings injection wellhead system for use in subsea wells is disclosed in U.S. Pat. No. 5,662,169. The wellhead system employs a wellhead having a conductor casing, to which is mounted a conductor housing and around which a guide base is provided. A high pressure housing is landed in the conductor housing. The wellhead system comprises an extension to the conductor housing extending between the lower end of the conductor housing and the conductor casing. A port is formed in the conductor housing extension below the guide base, allowing access to the interior of the conductor housing. A similar extension is provided on the lower end of the high pressure housing, formed with a corresponding port aligned with the port in the conductor casing. An inner casing is suspended from a casing hanger disposed within the high pressure housing. The ports in the extensions to the conductor housing and high pressure housing provide access to the annulus around the inner casing, into which a slurry of drilling cuttings may be injected. The pipework necessary to connect with the port in the conductor housing extension depends from the guide base provided around the wellhead assembly.

The wellhead system of U.S. Pat. No. 5,662,169 does not employ ports in the guide base, in order to gain access to an annulus within the wellhead and the well. However, the assembly of U.S. Pat. No. 5,662,169 requires the use of a modified conductor housing and high pressure housing, both of which must be provided with extensions through which aligned ports must be bored. In addition, the system of U.S. Pat. No. 5,662,169 requires the use of a dedicated guide base with the necessary pipework and connections in order to allow cuttings injection to proceed.

It is noted that the prior art teaches, in general, that it is required to employ a dedicated guide base in order to effect cuttings injection into a subsea wellhead. However, as wells are being drilled in deeper and deeper water, it is becoming increasingly difficult to employ a guide base. In very deep water, it is very difficult, if not impossible, to support and properly orient a guide base on a wellhead assembly from the surface. Accordingly, there is a need in the art to provide a system for injecting cuttings and other fluids into a well, without being required to rely upon a guide base, whether of conventional design or dedicated to allow for fluid re-injection.

Further, it can be seen that the systems proposed in the prior art require significant modifications to the components of the wellhead assembly in order to provide access to the annulus of choice within the well. It would be advantageous to provide a system for fluid injection requiring only a minimum of modifications to conventional wellhead assembly components.

It would be of further advantage if the system for cuttings injection could be operated in a well while drilling and other well operations were proceeding at the same time.

SUMMARY OF THE INVENTION

According to a first aspect of the present invention there is provided a wellhead assembly comprising:

an outer housing having a central bore therethrough;

an inner housing having a central bore therethrough and secured in the central bore of the outer housing, the inner housing having a first end within the outer housing;

a first inner casing having a central bore therethrough, the first inner casing being secured at a first end in the outer housing and spaced from the first end of the inner housing;

a port through the outer housing in communication with the central bore therethrough, the port opening into the central bore of the outer housing between the first end of the inner housing and the first end of the first inner casing;

a second inner casing secured in the wellhead assembly at a first end, whereby the port opens into the central bore of the outer housing between the first end of the first inner housing and the first end of the second inner housing, an annulus being formed between the first and second inner casings;

whereby a flowpath for fluid injection into a well in which the wellhead assembly is installed comprises the port in the outer housing and the annulus between the first and second inner casings.

A wellhead assembly according to the present invention allows access to be gained to an annulus between casings within the wellhead assembly and the well, into which a fluid may be injected, with a minimum of seals being required and a minimum of modifications being needed to existing or conventional wellhead assembly components. Further, the wellhead assembly allows fluid to be injected into the wellhead assembly and the well, while downhole operations such as drilling, are being conducted through the second inner casing.

The second inner casing is preferably secured at its first end within the central bore of the inner housing. In this arrangement, a collar is preferably disposed to extend from the first end of the inner housing between the opening of the port in the outer housing and the second inner casing. In this way, fluid injected into the wellhead assembly through the port is not allowed to impact the second inner casing, but rather is deflected to flow more longitudinally within the central bore of the outer housing.

A third inner casing is preferably provided, disposed to extend within the second inner casing and secured within the wellhead assembly. In this way, downhole operations may be conducted through the third inner casing, with at least one casing disposed between the third inner casing, the central bore of which is at well pressure, and the flowpath through which fluid is injected.

In a preferred embodiment, an intermediate casing is disposed within the wellhead assembly so as to extend within the first inner casing, in the annulus between the first inner casing and the second inner casing. The intermediate casing is preferably secured at a first end to the first inner casing in the annulus between the first and second inner casings. In such an arrangement, the first end of the intermediate casing may be sealed to the first inner casing, thereby ensuring fluid introduced into the wellhead assembly along the flowpath flows along the annulus between the intermediate inner casing and the second inner casing.

Preferably, a means for deflecting the flow of fluid entering the wellhead assembly through the port in the outer housing is deflected, so as not to impinge directly upon the second inner casing. As noted above, when the second inner casing is secured at one end within the inner housing, the means for deflecting the flow of fluid may be a collar extending from the first end of the inner housing. As an alternative, or in addition thereto, a sleeve may be provided to extend between the opening of the port in the outer housing and the second inner casing.

Fluid is preferably introduced into the wellhead assembly by means of a riser interface assembly connected to the port in the outer housing. The riser interface allows a riser to be connected between the port in the outer housing and a surface platform or vessel, through which fluid may be pumped into the well. The riser interface preferably comprises a valve for regulating the flow of fluid along the flowpath. The valve is most preferably a fail-safe closed valve, allowing the port and the interior of the outer housing to be sealed in the case of an emergency.

In a further aspect, the present invention provides a method for injecting a fluid into a well, which method comprises:

providing a wellhead assembly having an outer housing having a central bore therethrough and an inner housing secured within the central bore of the outer housing;

introducing a fluid into the central bore of the outer housing of the wellhead assembly at a point below the inner housing; and allowing the fluid to enter an annulus formed between a first inner casing secured at a first end in the wellhead assembly below the point of introduction of the fluid and a second inner casing secured at a first end above the point of introduction of the fluid;

the annulus extending between the first and second inner casings into the well.

The fluid is preferably introduced into the central bore of the outer housing through a port in the outer housing.

Once introduced into the outer housing, the fluid is preferably deflected in the region of the point of introduction, in order to prevent the fluid impinging directly upon the second inner casing. The deflection may be accomplished by having a collar extending from the inner housing between the point of introduction of the fluid and the second inner casing. As an alternative, or in addition thereto, a sleeve may be located in the central bore of the outer housing between the point of introduction of the fluid and the second inner casing.

The annulus entered by the fluid may be formed by an intermediate inner casing extending between the first inner casing and the second inner casing. In such an arrangement, the annulus entered by the fluid is preferably formed between the intermediate casing and the second inner casing. When an intermediate casing is provided, it is preferably secured in the first inner casing to thereby seal the annulus between the first inner casing and the intermediate casing.

The fluid being introduced into the wellhead assembly and the well may be any fluid which is required to be injected into the well. The method of the present invention is particularly suitable for use in the injection into a well of a slurry of drilling cuttings. In a most convenient embodiment of the present invention, the drilling cuttings have been produced by drilling operations conducted within the well. In other words, the present invention provides for the re-injection into a well of drilling cuttings produced from the well during drilling operations conducted in the well. This method represents a most efficient and cost-effective method of disposing of drilling cuttings produced during offshore drilling operations.

It is a further aspect of the present invention that the injection of fluid, in particular a slurry of drilling cuttings, into the wellhead assembly and the well may be carried out at the same time as well operations are being conducted through the second inner casing. In particular, the present invention allows for drilling operations to be performed and drilling cuttings produced as a result of the drilling operations simultaneously re-injected into the well.

Specific embodiments of the apparatus and method of the present invention will now be described in detail having reference to the accompanying drawings. The detailed description of these embodiments and the referenced drawings are by way of example only and are not intended to limit the scope of the present invention.

BRIEF DESCRIPTION OF THE DRAWINGS

Preferred embodiments of the present invention will now be described, by way of example only, having reference to the accompanying drawings, in which.

DETAILED DESCRIPTION OF THE PREFERRED EMBODIMENTS

Figure 1:
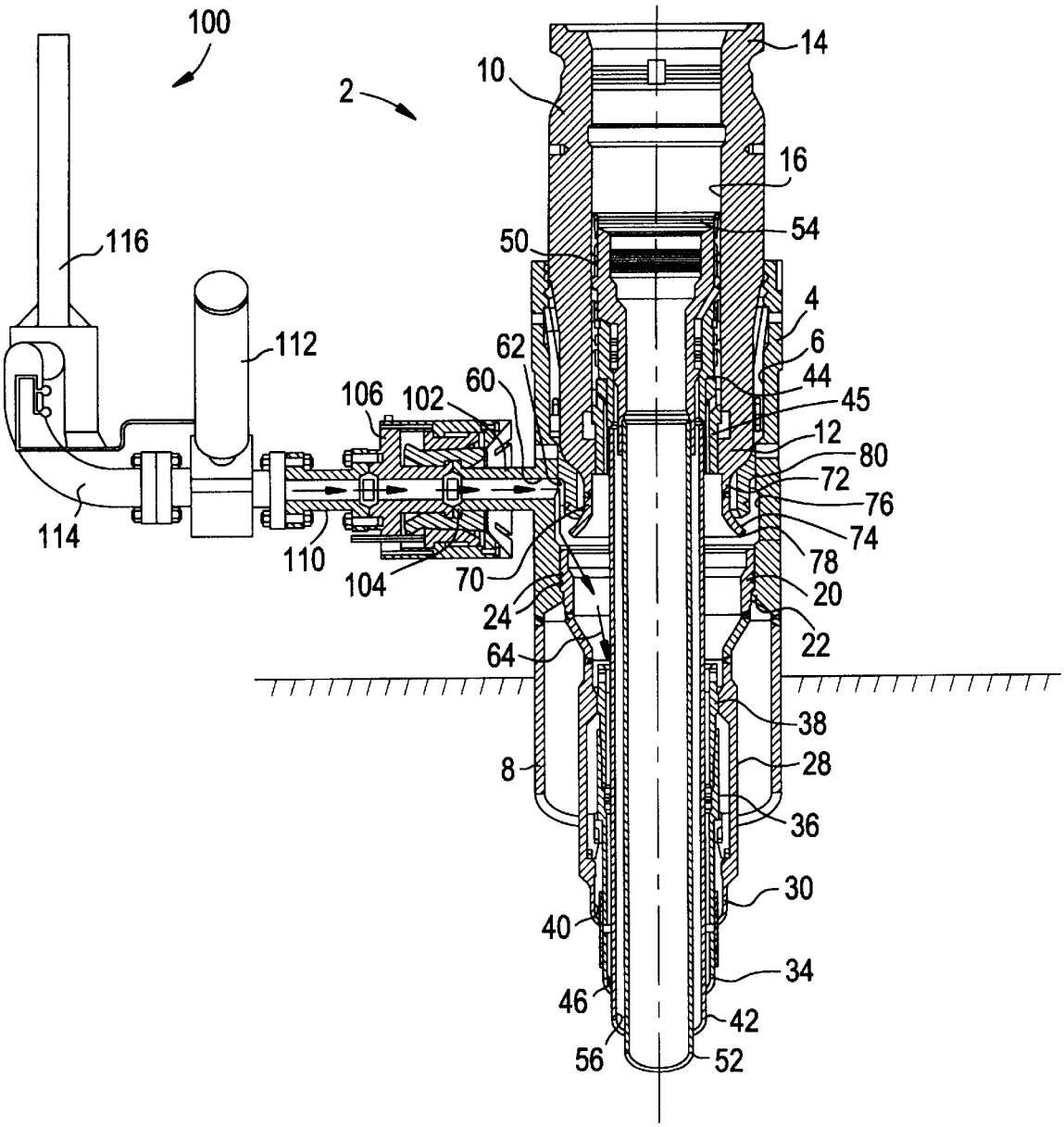
FIG. 1 is a side elevation cross-sectional view of an offshore wellhead assembly according to one embodiment of the present invention assembled without a guide base.

Referring to FIG. 1, a wellhead assembly according to one embodiment of the present invention is shown and generally indicated as 2 situated on the seabed over an offshore well. The wellhead assembly 2 comprises a conductor housing 4 as an outer housing, having a central bore 6 therethrough. A conductor pipe 8 is connected to the lower end of the conductor housing 4 and extends down into the well. The conductor pipe 8 typically has a nominal diameter of 30 inches.

A high pressure housing 10 is secured in the conductor housing 4, with its first end 12 extending within the central bore 6 of the conductor housing 4 and its second end 14 extending upwards from the upper end of the conductor housing. The high pressure housing 10 is secured in the conductor housing 4 by conventional means, well known in the art. A central bore 16 extends through the high pressure housing 10.

A first casing hanger 20 is landed on a shoulder 22 extending into the lower portion of the central bore of the conductor housing 4 and is sealed against the conductor housing 4 by means of seals 24 of conventional design. A hanger receptacle 28 extends from the lower end of the first casing hanger 20. A first inner casing 30 extends from the lower end of the hanger receptacle 28 into the well. The first inner casing 30 is typically of a nominal diameter of 20 inches.

An intermediate inner casing 34 extends within the first inner casing 30 into the well and is secured at its upper end by an intermediate casing hanger 36. An annular pack off 38 seals the intermediate casing hanger 36 to the hanger receptacle 28, thereby closing and sealing the annulus 40 between the first inner casing 30 and the intermediate inner casing 34. The intermediate inner casing 34 typically has a nominal diameter of 13⅜ inches.

A second casing hanger 44 is landed in the central bore 16 of the high pressure housing 10 and secures a second inner casing 42, such that it extends in the intermediate inner casing 34 into the well. An annular pack-off 45 seals the second casing hanger 44 to the high pressure housing 10. The second inner casing 42 typically has a nominal diameter of 9⅝ inches. An annulus 46 is formed between the intermediate inner casing 34 and the second inner casing 42.

A third casing hanger 50 is landed within the central bore 16 of the high pressure housing 10, above the second casing hanger 44, and supports a third inner casing 52, which extends within the second inner casing 42 into the well. An annular pack off 54 seals the third casing hanger 50 to the high pressure housing 10. An annulus 56 is formed between the second inner casing 42 and the third inner casing 52. The third inner casing 52 typically has a nominal diameter of 7⅝ inches.

It will be appreciated that the dimensions indicated above for the components of the wellhead assembly, in particular the inner casings, may vary considerably from the values given, according to the requirements of the well and the well operations being conducted in keeping with practice and techniques common to and well known in the art.

As shown in FIG. 1, a port 60 is formed in the conductor housing 4. The port 60 extends through the wall of the conductor housing 4 and has an opening 62 in the central bore 6 of the conductor housing 4. The port 60 is arranged such that the opening 62 is disposed within the central bore 6 of the conductor housing 4 below the first end 12 of the high pressure housing 10, and above the first casing hanger 20.

A flowpath for fluid, represented by arrows 64 comprises the port 60 in the conductor housing 4, a portion of the central bore 6 of the conductor housing 4 extending between the first end 12 of the high pressure housing 10 and the first casing hanger 20. Fluid injected into the port 60 will follow the aforementioned flowpath, passing through the first casing hanger 20 and entering an annulus between the first inner casing 30 and the second inner casing 42. In the arrangement shown in FIG. 1, the fluid flowpath comprises the annulus 46 between the intermediate inner casing 34 and the second inner casing 42. The annular pack off 38 prevents fluid from entering the annulus 40 between the first inner casing 30 and the intermediate inner casing 34. In an alternative embodiment, should access be required to the annulus 40, the annular pack off 38 may be omitted or modified to provide passages for fluid flow therethrough. The fluid flow path is also contained by the pack-off 45 sealing the second casing hanger 44 to the high pressure housing 10, preventing the fluid from flowing into the annulus 56 located between the second inner casing 42 and the third inner casing 52. The fluid flow path is also contained by the impingement sleeve 80 that seals between the first end 12 of the high pressure housing 10 and the bore 6 of the conductor housing 4.

The port 60 is shown in FIG. 1 as extending radially through the conductor housing 4 perpendicular to the longitudinal axis of the conductor housing. It is to be noted, however, that the port 60 may be formed to extend through the conductor housing 4 at other angles to the longitudinal axis. The angle of the port 60 may thus be varied to direct fluid along the flowpath into the conductor housing 4 at the desired angle to the interior components of the wellhead assembly 2, as well as allowing the components external to the conductor housing 4 to be oriented as required in order to be accommodated by other surrounding wellhead equipment.

Fluid entering the central bore 6 of the conductor housing 4 through the port 60 may be allowed to impinge directly on the outside of the second inner casing 42. Preferably, means are provided to deflect the fluid flow, in order to prevent direct impingement of the entering fluid against the second inner casing. In this way, erosion and damage of the second inner casing in the region of the opening 62 of the port 60 is reduced or substantially prevented. Solids in the fluid being injected, such as drilling cuttings, can give rise to severe erosion of components, particularly when injected under high pressure into a wellhead assembly. A sleeve may be provided to extend within the central bore 6 of the conductor housing 4 below the high pressure housing 10 between the opening 62 of the bore 60. One preferred arrangement is shown in Figure. A collar 70 extends from the first end 12 of the high pressure housing 10 towards the first casing hanger 20. The collar 70 comprises a first portion 72 extending substantially parallel to the longitudinal axis of the conductor housing 4. A second portion 74 of the collar 70 extends downwards and outwards (as viewed in FIG. 1) towards the conductor housing 4. In this way, a fluid entry cavity 76 is formed in the region of the opening 62 in the conductor housing 4. An inner opening 78 in the form of a circular slit is formed between the second portion 74 of the collar 70 and the first casing hanger 20, connecting the fluid entry cavity 76 with the central bore 6 of the conductor housing 4 and the fluid flowpath within the wellhead assembly 2 and the well.

An impingement sleeve 80 is disposed within the fluid entry cavity between the collar 70 and the opening 62 of the port 60. Fluid entering the conductor housing 4 through the port 60 and the opening 62 is first caused to impinge directly upon the impingement sleeve 80, before flowing through the fluid entry cavity 76 into the central bore 6 of the conductor housing 4. The impingement sleeve 80 is shown in FIG. 1 as being a separate component. This allows the impingement sleeve 80 to be selectively installed or omitted, depending upon the required duty of the wellhead assembly and the nature of the fluid intended to be injected. If erosion occurs within the wellhead assembly 2, this will be concentrated on the impingement sleeve 80. This further allows the impingement sleeve 80 alone to be replaced, without the need to discard other components of the wellhead assembly 2.

As shown in FIG. 1, a riser interface assembly, generally indicated as 100, is connected to the port 60 in the conductor housing 4. The riser interface assembly 100 may be connected to the port by means of any of the standard fittings and connection means known in the art. Suitable connection means include male and female unions, stab-in unions, as well as flanged connections. One particular suitable arrangement is shown in FIG. 1. A spigot 102 extends from the conductor housing 4 in communication with the port 60. The spigot 102 has a hub 104 at its free end. A hydraulic connector 106 of conventional design secures the riser interface assembly 100 to the spigot 102 by means of the hub 104.

The riser interface assembly 100 comprises a flanged spool 110 extending between a valve 112 and the hydraulic connector 106. The valve 112 may be any suitable valve design to control the flow of fluid into the wellhead assembly 2. The valve 112 is preferably a fail-safe closed valve, such that, in the event of an emergency or failure of the valve control system, the fluid flowpath and the interior of the conductor housing 4 are sealed, to prevent fluid leaking from the wellhead assembly 2 into the surrounding environment. A flow loop 114 extends from the valve 112 to a riser interface 116. A riser (not shown) is used to connect the riser interface assembly 100 and the wellhead assembly 2 to a surface vessel or platform, from where fluid, in particular a slurry of drilling cuttings, may be injected into the wellhead.

It is to be noted that the riser interface assembly 100 is self contained and independent of other subsurface equipment. The assembly of the present invention thus allows fluid to be injected into the wellhead assembly 2 independent of other well operations and without requiring other subsurface equipment to be installed.

In operation, a fluid, such as a slurry of drilling cuttings, is provided at a platform or surface vessel, from where it is pumped under pressure through a riser connected to the riser interface assembly 100. From the riser interface assembly 100, the fluid enters the port 60 in the conductor housing 4 and enters the fluid entry cavity 76, where it impinges on the impingement sleeve 80. The fluid is diverted by the impingement sleeve 80 to flow through the fluid entry cavity 76, exiting through the inner opening 78 into the central bore 6 of the conductor housing 4. From here, the fluid enters the annulus 46 between the intermediate inner casing 34 and the second inner casing 42 and flows into the well. The fluid will leave the annulus 46 at the lower end of the intermediate casing 34 within the well, from where it can pass into the underground formation. If desired, the intermediate casing 34 may be perforated in order to provide access for the fluid to one or more underground formations. The annulus 46 is a most convenient annulus to employ for underground fluid injection in this manner, as the intermediate casing 34 extends to a level deep within the well. In this way, the risk of fluids injected into the underground formation by the aforementioned method finding their way to the seabed is lowered. In this way, the risks of environmental damage to the seabed and surrounding water are minimized. As noted above, the annulus 40 between the first inner casing 30 and the intermediate inner casing 34 may also be employed. However, in this case, it should realized that, typically, the first inner casing 30 does not extend to such a greater depth within the well as the intermediate inner casing 34.

As noted above, it is a significant feature of the present invention that the wellhead assembly may be arranged for the injection of fluid into the well and the aforementioned method of fluid injection carried out without a guide base being required. As also noted above, this is of significant advantage in the case of deep water wells, where equipment is often run to the wellhead from a surface platform or vessel without the use of a guide base. This is in contrast to the wellhead assemblies and methods of the prior art. If a guide base is required, however, the wellhead assembly of the present invention accommodates the installation of a guide base.

Figure 2:
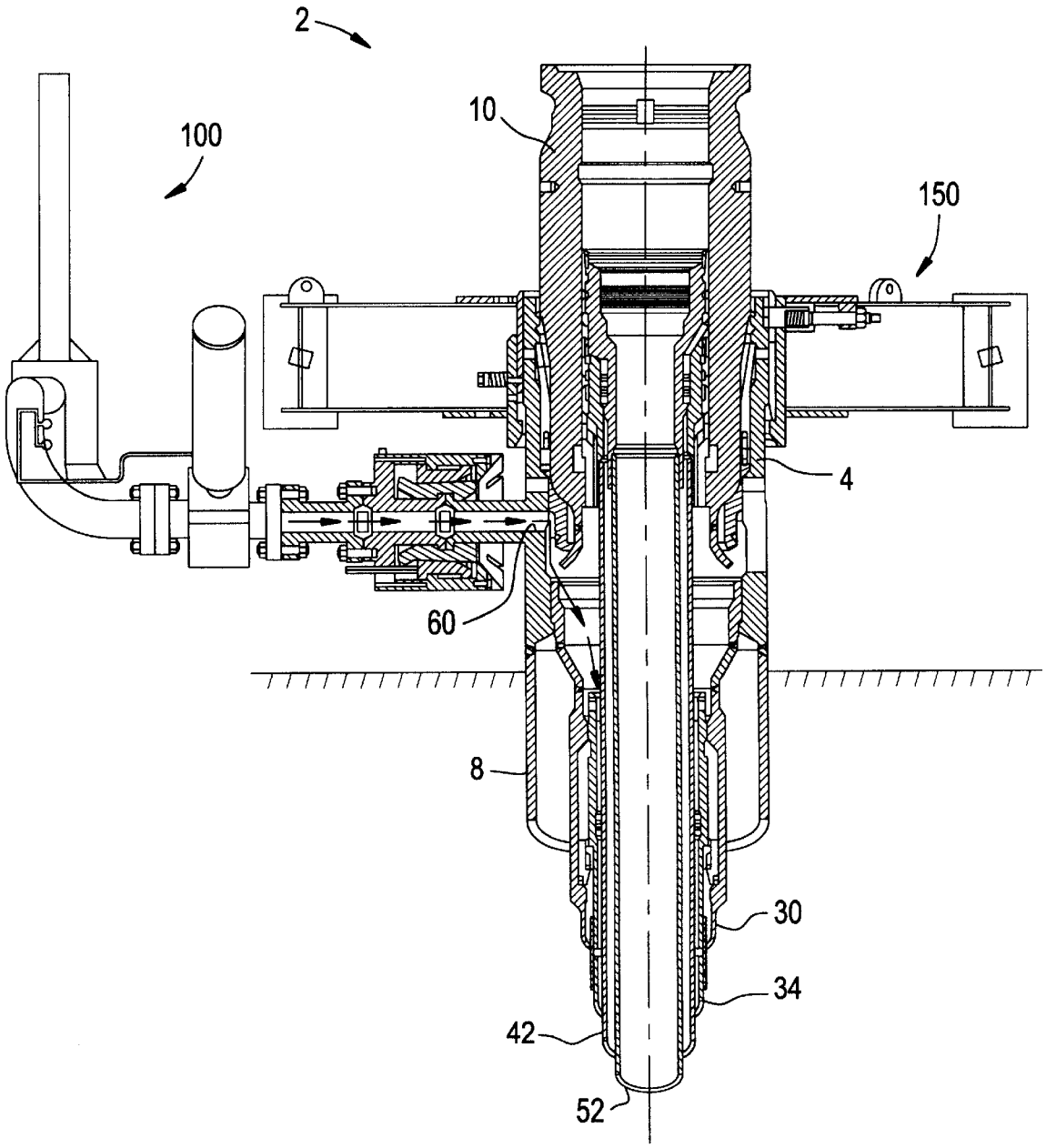
FIG. 2 is a side elevation cross-sectional view of an offshore wellhead assembly according to a further aspect of the present invention, in which a guide base is present.

Referring to FIG. 2, the wellhead assembly of FIG. 1 is shown, with a guide base installed. The wellhead assembly 2 has a guide base 150 secured around the upper portion of the conductor housing 4 in the conventional manner. It will be noted that the port 60 and the associated riser interface assembly 100 are positioned to be clear of the guide base 150, allowing the guide base 150 to installed and removed, as required, without disturbing the riser interface assembly 100 or interrupting fluid injection operations.

Figure 3:
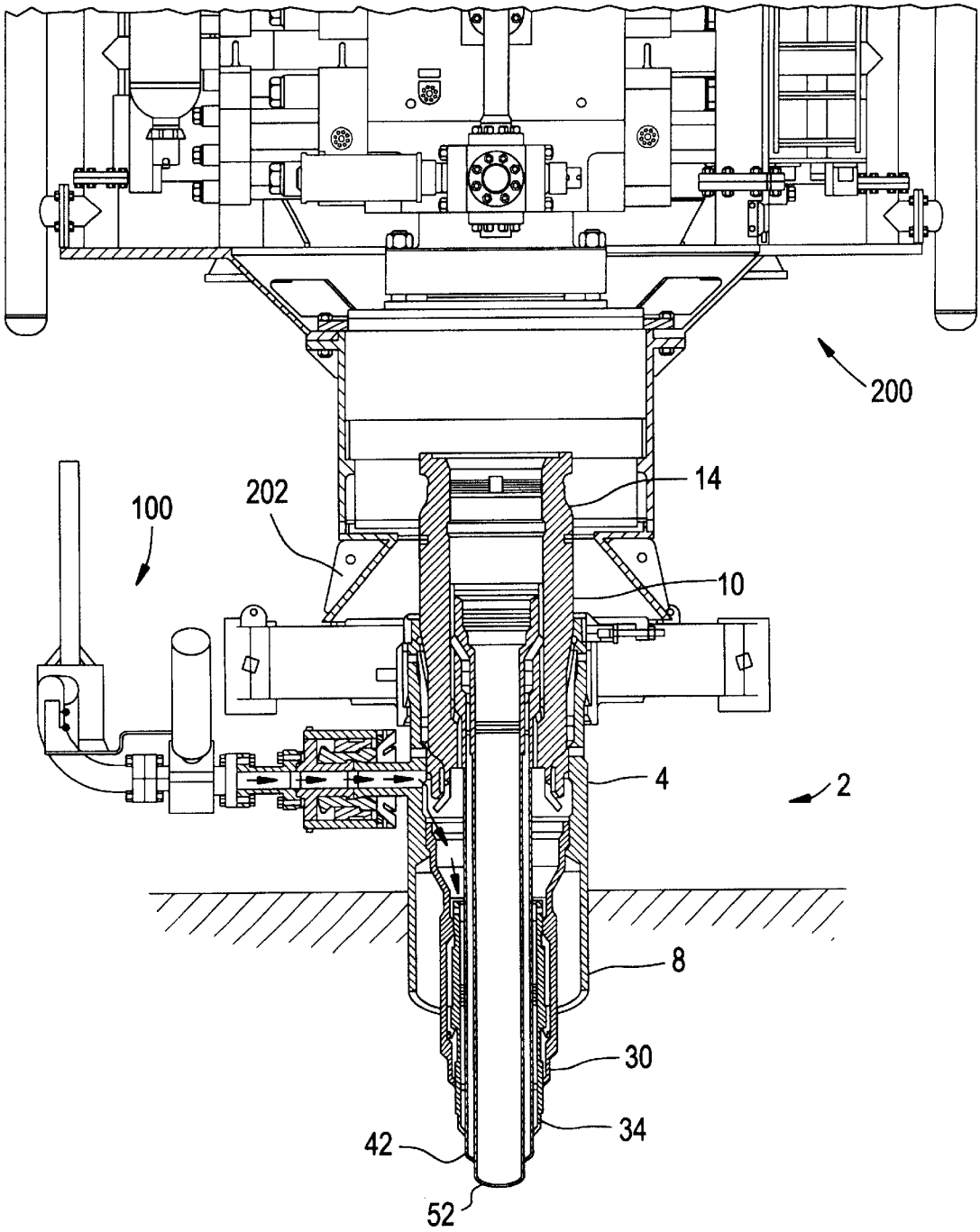
FIG. 3 is a side elevation cross-sectional view of the offshore wellhead assembly of FIG. 2 with a blowout preventer (BOP) stack in place on the wellhead assembly.

FIG. 3 shows the wellhead assembly of FIG. 2 with a blowout preventer (BOP) stack installed. A BOP stack 200, of conventional design, is installed on the second end 14 of the high pressure housing 10. The BOP stack 200 has a downwards facing guide funnel 202, used when installing the BOP stack 200 to guide the stack onto the high pressure housing 10 of the wellhead assembly 2. Once installed, in the position shown in FIG. 3, the guide funnel 202 extends substantially below the second end 14 of the high pressure housing. As shown in FIG. 3, the wellhead assembly of the present invention allows the equipment required for fluids injection to be sited well below the second end of the high pressure housing 10, allowing the BOP stack 200 to be installed and removed, as required, without interfering with the fluid injection system.

While the preferred embodiments of the present invention have been shown in the accompanying figures and described above, it is not intended that these be taken to limit the scope of the present invention and modifications thereof can be made by one skilled in the art without departing from the spirit of the present invention.

What I claim is:

1. A wellhead assembly comprising:

an outer housing having a central bore therethrough;

an inner housing having a central bore therethrough and secured in the central bore of the outer housing, the inner housing having a first end within the outer housing;

a first inner casing having a central bore therethrough, the first inner casing being secured at a first end in the outer housing and spaced from the first end of the inner housing;

a port through the outer housing in communication with the central bore therethrough, the port opening into the central bore of the outer housing between the first end of the inner housing and the first end of the first inner casing;

a second inner casing secured in the wellhead assembly at a first end, whereby the port opens into the central bore of the outer housing between the first end of the first inner casing and the first end of the second inner casing, an annulus being formed between the first and second inner casings;

whereby a flowpath for fluid injection into a well in which the wellhead assembly is installed comprises the port in the outer housing and the annulus between the first and second inner casings, wherein the second inner casing is secured at its first end within the central bore of the inner housing; and, wherein a collar extends from the first end of the inner housing between the opening of the port in the outer housing and the second inner casing.

2. The wellhead assembly as claimed in claim 1, further comprising a third inner casing secured in the wellhead assembly and extending within the second inner casing.

3. The wellhead assembly as claimed in claim 1, further comprising an intermediate inner casing secured within the wellhead assembly and extending within the first inner casing in the annulus between the first inner casing and the second inner casing.

4. The wellhead assembly as claimed in claim 3, wherein the intermediate inner casing is secured at a first end within the first inner casing in the annulus between the first inner casing and the second inner casing.

5. The wellhead assembly as claimed in claim 4, wherein the first end of the intermediate casing is sealed to the first inner casing, the flowpath comprising the port in the outer housing and an annulus between the intermediate inner casing and the second inner casing.

6. The wellhead assembly as claimed in claim 1, further comprising a sleeve disposed in the central bore of the outer housing, the sleeve extending between the opening of the port in the outer housing and the second inner casing.

7. The wellhead assembly as claimed in claim 1, further comprising a riser interface assembly connected to the port in the outer housing.

8. The wellhead assembly as claimed in claim 7, wherein the riser interface assembly comprises a valve for regulating the flow of fluid through the flowpath.

9. The wellhead assembly as claimed in claim 8, wherein the valve is a fail-safe closed valve.

10. The wellhead assembly as claimed in claim 1, wherein the flowpath is established without a guide base.

11. A method for injecting a fluid into a well, which method comprises:

providing a wellhead assembly having an outer housing having a central bore therethrough and an inner housing secured within the central bore of the outer housing;

introducing a fluid into the central bore of the outer housing of the wellhead assembly at a point below the inner housing;

allowing the fluid to enter an annulus formed between a first inner casing secured at a first end in the wellhead assembly below the point of introduction of the fluid and a second inner casing secured at a first end above the point of introduction of the fluid; and, the annulus extending between the first and second inner casings into the well, wherein the fluid is deflected in the region of the point of introduction and wherein the fluid is deflected by a collar extending from the inner housing between the point of introduction of the fluid and the second inner casing.

12. The method as claimed in claim 11, wherein the fluid is introduced into the outer housing through a port in the outer housing.

13. The method as claimed in claim 11, wherein the fluid is deflected by a sleeve located in the central bore of the outer housing between the point of introduction of the fluid and the second inner casing.

14. The method as claimed in claim 11, wherein the annulus is formed by an intermediate inner casing extending between the first inner casing and the second inner casing.

15. The method as claimed in claim 14, wherein the annulus is formed between the intermediate inner casing and the second inner casing.

16. The method as claimed in claim 15, wherein the intermediate casing is secured in the first inner casing, thereby sealing the annulus between the first inner casing and the intermediate inner casing.

17. The method as claimed in claim 11, wherein the fluid is a slurry of drilling cuttings.

18. The method as claimed in claim 17, wherein the drilling cuttings have been produced from drilling operations conducted in the well.

19. The method as claimed in claim 11, wherein the injection of fluid is carried out simultaneously with a downhole operation being conducted through the second inner casing.

20. The method as claimed in claim 19, wherein the downhole operation is drilling.

21. The method as claimed in claim 11, wherein the fluid is injected into the well in the absence of a guide base.

* * * * *